US010260023B2

(12) United States Patent
Kannan et al.

(10) Patent No.: US 10,260,023 B2
(45) Date of Patent: Apr. 16, 2019

(54) PREPARATION OF FUNCTIONALIZED CASTOR OIL DERIVATIVES USING SOLID ACID AND BASE CATALYSTS

(71) Applicant: Council of Scientific and Industrial Research, New Delhi (IN)

(72) Inventors: Srinivasan Kannan, Bhavnagar (IN); Sankaranarayanan Sivashunmugam, Bhavnagar (IN)

(73) Assignee: Council of Scientific and Industrial Research, New Delhi (IN)

( * ) Notice: Subject to any disclaimer, the term of this patent is extended or adjusted under 35 U.S.C. 154(b) by 0 days.

(21) Appl. No.: 15/327,876

(22) PCT Filed: Aug. 6, 2015

(86) PCT No.: PCT/IN2015/050084

§ 371 (c)(1),
(2) Date: Jan. 20, 2017

(87) PCT Pub. No.: WO2016/020941

PCT Pub. Date: Feb. 11, 2016

(65) Prior Publication Data

US 2017/0211015 A1 Jul. 27, 2017

(30) Foreign Application Priority Data

Aug. 6, 2014 (IN) ..... 2225/DEL/2014

(51) Int. Cl.

| | |
|---|---|
| ***C11C 3/00*** | (2006.01) |
| ***C11C 3/04*** | (2006.01) |
| ***C11C 3/14*** | (2006.01) |

(52) U.S. Cl.

CPC ..... *C11C 3/00* (2013.01); *C11C 3/003* (2013.01); *C11C 3/04* (2013.01); *C11C 3/14* (2013.01)

(58) Field of Classification Search

CPC ..... C11C 3/00; C11C 3/04; C11C 3/14; C11C 3/003

See application file for complete search history.

(56) References Cited

FOREIGN PATENT DOCUMENTS

| | | | |
|---|---|---|---|
| KR | 201476033 A | * | 6/2014 |
| WO | WO-2012111023 | | 8/2012 |
| WO | WO-2016020941 | | 2/2016 |

OTHER PUBLICATIONS

KR,1020140076033 English Machine Translation ProQuestDocuments—Nov. 9, 2017; p. 1-23.*

Sánchez-Cantú, M., "Green synthesis of hydrocalumite-type compounds and their evaluation in the transesterification of castor bean oil and methanol." Fuel 110 (2013): 23-31.*

"International Application No. PCT/IN2015/050084, Informal Comments to the Written Opinion of the International Search Authority dated Apr. 19, 2016", (Apr. 19, 2016), 6 pgs.

"International Application No. PCT/IN2015/050084, International Search Report and Written Opinion dated Feb. 5, 2016", (Feb. 5, 2016), 14 pgs.

Desroches, Myriam, et al., "From Vegetable Oils to Polyurethanes: Synthetic Routes to Polyols and Main Industrial Products", Polymer Reviews, Taylor & Francis, 2012, 52 (1), pp. 38, (Jan. 1, 2012), 98 pgs.

Pal, Rammohan, et al., "Amberlyst-15 in organic synthesis", Reviews and Accounts, Arkivoc 2012 (i) 570-609, (Jan. 1, 2012), 570-609.

Romero, Rubi, et al., "Biodiesel Production by Using Heterogeneous Catalysts", Alternative Fuel, InTech, (Aug. 9, 2011), 20 pgs.

Salimon, Jumat, et al., "Synthesis, reactivity and application studies for different biolubricants", Chemistry Central Journal 2014, 8:16, (Mar. 10, 2014), 11 pgs.

Simonetti, Evelyn Alves Nunes, et al., "Transesterification of Soybean Oil with Ethanol Using Heterogeneous Catalysts Based on Hydrotalcites", Energy and Environment Research; vol. 3, No. 1; 2013, (Jan. 29, 2013), 8 pgs.

Yu, J. H., "Castor Oil Based Bio-Urethane Nanocomposites", The 19th International Conference on Composite Materials, Aug. 2, 2013, (Aug. 2, 2013), 11 pgs.

Ahn, B. Kollbe, et al., "Ring opening of epoxidized methyl oleate using a novel acid-functionalizediron nanoparticle catalyst", *Green Chemistry*, 14, (2012), 136-142.

Doll, Kenneth M., et al., "Bismuth(III) Trifluoromethanesulfonate Catalyzed Ring-Opening Reaction of Mono Epoxy Oleochemicals to Form Keto and Diketo Derivatives", *ACS Sustainable Chem. Eng.*, 1, (2013), 39-45.

Doll, Kenneth M., et al., "Synthesis of cyclic acetals (ketals) from oleochemicals using a solvent free method", *Green Chemistry*, 10, (2008), 712-717.

Guidotti, Matteo, et al., "An efficient ring opening reaction of methyl epoxystearate promoted bysynthetic acid saponite clays", *Green Chemistry*, 11, (2009), 1173-1178.

Guo, Yinzhong, et al., "Hydrolysis of Epoxidized Soybean Oil in the Presence of Phosphoric Acid", *J Am Oil Chem Soc*, 84, (2007), 929-935.

(Continued)

*Primary Examiner* — John M Mauro

(74) *Attorney, Agent, or Firm* — Schwegman Lundberg & Woessner, P.A.

(57) ABSTRACT

This invention relates to the development of processes for the preparation of functionalized castor oil derivatives namely ring-opened glyceryl ricinoleates, epoxy alkyl ricinoleates and ring-opened alkyl ricinoleates with tailorable properties from epoxidized castor oil as raw material using heterogeneous acid and base catalysts. More particularly, the invention employs two reaction chemistries namely ring-opening and transesterification using Amberlyst 15 as solid acid catalyst for the former and oxides derived from CaAl layered double hydroxide (CaAl-LDH) as solid base catalyst for the latter and combinations thereof. Furthermore, both the catalysts are reusable and the products are easily separable after the reaction by simple physical processes.

12 Claims, 1 Drawing Sheet

(56) References Cited

OTHER PUBLICATIONS

Holser, Ronald A., et al., "Transesterification of epoxidized soybean oil to prepare epoxy methyl esters", *Industrial Crops and Products*, 27, (2008), 130-132.
Lathi, Piyush S., et al., "Green approach for the preparation of biodegradable lubricant base stock from epoxidized vegetable oil", *Applied Catalysis B: Environmental*, vol. 69, Issues 3-4, (2007), 207-212.
Li, Eugena, et al., "MgCoAl-LDH derived heterogeneous catalysts for the ethanol transesterification of canola oil to biodiesel", *Applied Catalysis B: Environmental*, vol. 88, Issues 1-2, (2009), 42-49.
Rios, Luis A., et al., "Resin catalyzed alcoholysis of epoxidized fatty esters: Effect of the alcohol and the resin structures", *Applied Catalysis A: General*, vol. 284, Issues 1-2, (2005), 155-161.
Sharma, Brajendra K., et al., "Synthesis of Hydroxy Thio-ether Derivatives of Vegetable Oil", *Journal of Agricultural and Food Chemistry*, 54, (2006), 9866-9872.
Xie, W. L., et al., "Calcined Mg—Al hydrotalcites as solid base catalysts for methanolysis of soybean oil", *Journal of Molecular Catalysis A-Chemical*, vol. 246, No. 1-2, (2006), 24-32.

* cited by examiner

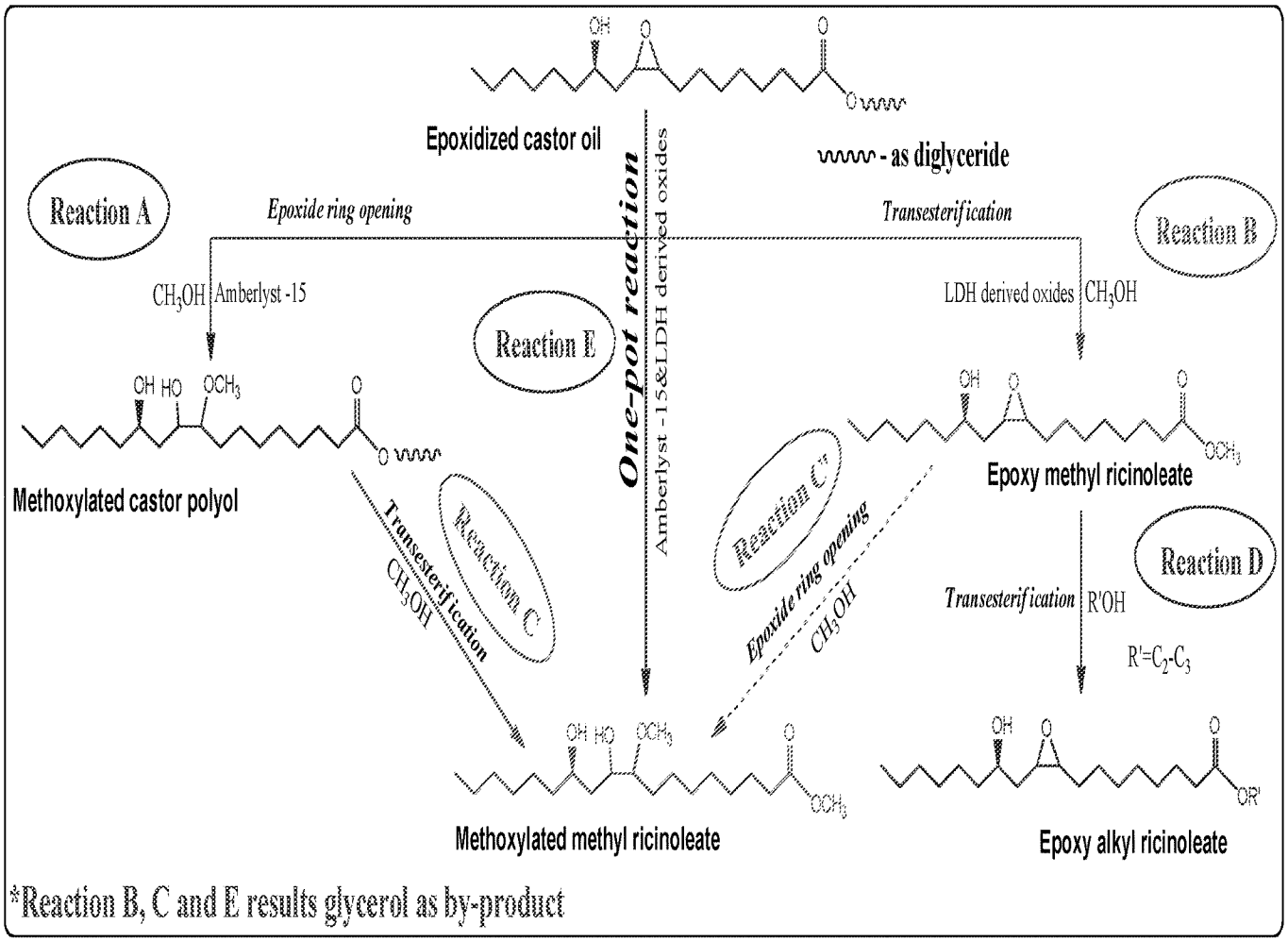
Epoxidized castor oil
- as diglyceride
Epoxide ring opening
Transesterification
Reaction A
Reaction B
Reaction C
Reaction D
Reaction E
CH3OH
Amberlyst -15
LDH derived oxides
Methoxylated castor polyol
Epoxy methyl ricinoleate
Epoxy alkyl ricinoleate
Epoxide ring opening
CH3OH
Transesterification
CH3OH
Transesterification
R'OH
R'=C2-C3
One-pot reaction
Amberlyst - 15&LDH derived oxides
Methoxylated methyl ricinoleate
*Reaction B, C and E results glycerol as by-product

PREPARATION OF FUNCTIONALIZED CASTOR OIL DERIVATIVES USING SOLID ACID AND BASE CATALYSTS

PRIORITY CLAIM TO RELATED APPLICATIONS

This application is a U.S. national stage application filed under 35 U.S.C. § 371 from International Application Serial No. PCT/IN2015/050084, which was filed 6 Aug. 2015, and published as WO2016/020941 on 11 Feb. 2016, and which claims priority to Indian Application No. 2225/DEL/2014, filed 6 Aug. 2014, which applications and publication are incorporated by reference as if reproduced herein and made a part hereof in their entirety, and the benefit of priority of each of which is claimed herein.

FIELD OF THE INVENTION

Present invention relates to a processes for the preparation of functionalized castor oil derivatives (ring-opened glyceryl ricinoleates, epoxy alkyl ricinoleates and ring-opened alkyl ricinoleates) with tailorable physical properties from epoxidized castor oil as raw material using recyclable solid (acid/base) catalysts wherein functionalization could be achieved either at the fatty chain region or the ester linkage without one affecting the other or at both by choosing proper reaction chemistry/catalysts.

BACKGROUND OF THE INVENTION

Castor oil, one of the promising non-edible oils, is effectively employed in many industrial processes for making various chemicals besides being used for centuries for medicinal purposes. In world, ~1.2 million tons of castor oil are produced every year and India occupies the top place for castor production with nearly ~60% of overall production followed by China and Brazil. Castor oil, being highly stable (longer shelf life) besides relatively inexpensive coupled with their unique functionality makes it superior over many other vegetable oils. In its fatty composition, >85% is constructed by ricinoleic acid which makes castor oil an important raw material for various commercial applications.

Sharma et al. in their paper "Synthesis of hydroxy thio-ether derivatives of vegetable oil" in *J. Agric. Food Chem.* (2006) 54, 9866-9872) reported the synthesis of hydroxy thio-ether derivatives from epoxidized soybean oil and 1-butanethiol at 45° C. Use of homogeneous perchloric acid as catalyst and requirement of additional chemicals are drawbacks of this work.

Guo et al. in their paper "Hydrolysis of epoxidized soybean oil in the presence of phosphoric acid" in *J. Am. Oil Chem. Soc.* (2007) 84, 929-935 reported hydrolysis of epoxidized soybean oil in the presence of phosphoric acid. They found that t-butanol is the best solvent for the preparation of soybean based polyols. Use of homogeneous phosphoric acid as catalyst is the main drawback of the work.

Lathi and Mattiasson in their paper "Green approach for the preparation of biodegradable lubricant base stock from epoxidized vegetable oil" in *Appl. Catal. B.*, (2007) 69, 207-212 reported sequential ring opening of epoxidized soybean oil with $C_4$+ alcohols followed by esterification with acetic anhydride using Amberlyst-15. Though, they used reusable Amberlyst 15 catalyst, requirement of longer reaction time (15 h) is the main drawback of the process.

Doll and Erhan in their paper "Synthesis of cyclic acetals (ketals) from oleochemicals using a solvent free method" in *Green Chem.* (2008) 10, 712-717 reported the preparation of fatty acetals and branched fatty esters from epoxidized methyl oleate using acidic catalysts. Use of homogeneous liquid acid catalysts ($H_3PO_4$ and $H_2SO_4$) is the main drawback of the work.

Guidotti et al. in their paper "An efficient ring opening reaction of methyl epoxystearate promoted by synthetic acid saponite clays" in *Green Chem.* (2009) 11, 1173-1178 reported the ring opening reaction of methyl epoxystearate with methanol using synthetic acid saponite clays and obtained 90% conversion of epoxide within 1 h. Necessity of pretreating the catalysts at 150° C. in air is the drawback of this work.

Ahn et al. in their paper "Ring opening of epoxidized methyl oleate using a novel acid-functionalized iron nanoparticle catalyst" in *Green Chem.* (2012) 14, 136-142 reported the ring opening of epoxidized methyl oleate using acid-functionalized iron nanoparticle as catalysts and obtained stoichiometric yield of products similar to that of $H_2SO_4$. The requirement of many chemicals, necessity of inert gas during synthesis, sensitive synthetic procedures, and longer time to prepare active catalysts are the main drawbacks of the work.

Doll et al. in their paper "Bismuth (III) trifluoromethanesulfonate catalyzed ring-opening reaction of mono epoxy oleochemicals to form keto and diketo derivatives" in *ACS Sustainable Chem. Eng.* (2013) 1, 39-45 reported the preparation of keto and diketo derivatives from epoxidized methyl oleate using bismuth (III) trifluoromethanesulfonate as catalyst in which later mentioned ketone was prepared in pres-

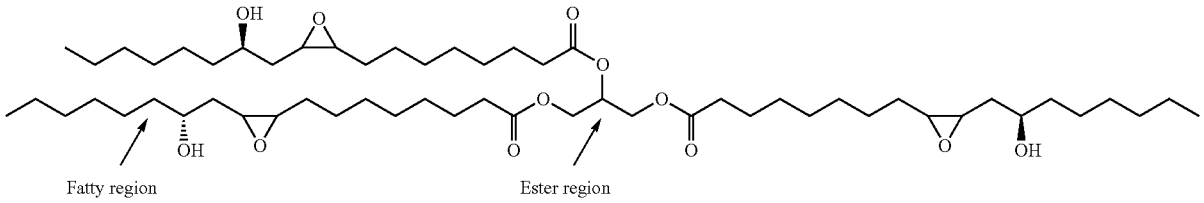

Structure of Epoxidized Castor Oil

Epoxides of oils and fatty derivatives are valuable intermediates for the production of several chemicals that have many industrial applications and epoxidized castor oil is no exception. Owing to the presence of highly active oxirane ring, epoxidized fatty derivatives can easily undergo various chemical transformations. The products derived from fatty epoxides are useful in bioplasticizers, surfactants and coatings, polymers, lubricant additives, hydraulic & dielectric fluids, as antifriction/antioxidant and antiwear in automotives, polyurethanes and as lubricants.

ence of dimethyl sulfoxide (DMSO). Non-reusable homogeneous catalysts and performing reactions under stringent conditions (nitrogen filled glove box) are the drawbacks of this work.

Transesterification of epoxidized oils with alcohols result epoxy fatty alkyl esters and are useful as surfactants, fuel additives and in other industrial process. This process is similar to the preparation of fatty acid alkyl esters (biodiesel) by transesterification of vegetable oils with alcohols.

Ronald A. Holser in his paper "Transesterification of epoxidized soybean oil to prepare epoxy methyl esters" in *Ind. Crop. Prod.* (2008) 27, 130-132 reported the transesterification of epoxidized soybean oil with sodium methoxide as catalyst and achieved complete conversion within 10 min. at 50° C. Reaction performed using non-recyclable homogeneous catalyst is the main drawback of this work.

Objectives of the Invention

The main objective of the present invention is to prepare functionalized castor oil derivatives from epoxidized castor oil (ECO) as a raw material.

Yet another objective of the present invention to functionalize specific region of the ECO without affecting the other region by selecting proper reaction chemistry.

Yet another objective of the present invention is to use heterogeneous catalysts for the preparation of functionalized castor oil derivatives.

Still another objective of the present invention is to prepare ring-opened glyceryl ricinoleates using commercially available Amberlyst 15 as acid catalyst without affecting the ester region.

Still another objective of the present invention is to prepare epoxy alkyl ricinoleates using easily synthesizable oxides derived from CaAl-layered double hydroxide (LDH) as base catalyst through transesterification of epoxidized castor oil/epoxy methyl ricinoleate without affecting fatty region.

Still another objective of the present invention is to prepare ring-opened alkyl ricinoleates from ECO by using both Amberlyst 15 and oxides derived from CaAl-LDH as catalysts by two-pot reactions such as ring opening of ECO followed by transesterification (or) vice versa by doing functionalization at both the regions.

Still another objective of the present invention is to prepare ring-opened alkyl ricinoleates from ECO by using both Amberlyst 15 and oxides derived from CaAl-LDH as catalysts in a one-pot reaction.

Still another objective of the present invention is to recycle the catalyst by developing a simple method.

Still another objective of the present invention is to vary the physical properties of the functionalized derivatives by selecting different nucleophiles/alcohols.

Still another objective of the present invention is to tailor the physical properties of the derived functionalized derivatives by blending.

Still another objective of the present invention is to demonstrate the process at higher scale.

BRIEF DESCRIPTION OF THE DRAWING

The FIGURE represents preparation of functionalized castor oil derivatives (represented as methyl derivatives).

SUMMARY OF THE INVENTION

Accordingly, present invention provides a process for the preparation of functionalized castor oil derivatives from epoxidized castor oil (ECO) via ring-opening and/or transesterification, wherein conversion percentage of epoxidized castor oil is in the range of 82 to 91% comprising the steps of:

i. mixing epoxidized castor oil with a reactant at room temperature in the range of 20 to 30° C. to obtain a mixture;

ii. adding catalyst(s) to the mixture as obtained in step (i) in the range of 0.5-20 wt. % with respect to oil to obtain a mixture;

iii. stirring the mixture as obtained in step (ii) at temperature in the range of 27-105° C. for period in the range of 1 to 7 hours followed by decanting/filtering the catalyst to obtain the product mixture;

iv. removing unreacted reagents and solvent from the mixture obtained in step (iii) by rotary evaporation, and if necessary preceded by solvent extraction with hexane to obtain functionalized castor oil derivatives;

v. mixing functionalized castor oil derivative as obtained in step (iv) with reactant as in step (i) and following the step (ii) to (iv) to obtain functionalized castor oil derivatives.

In an embodiment of the present invention, functionalized castor oil derivatives are selected from the group consisting of ring-opened glyceryl ricinoleates, epoxy alkyl ricinoleates and ring-opened alkyl ricinoleates.

In another embodiment of the present invention, reactant used in step (i) is methanol to obtain ring-opened glyceryl ricinoleate via ring-opening and to obtain epoxy methyl ricinoleate via transesterification.

In yet another embodiment of the present invention, toluene is added as solvent to the mixture obtained in step (i) before the addition of catalyst to obtain ring-opened glyceryl ricinoleates and ring-opened alkyl ricinoleates.

In yet another embodiment of the present invention, water is added to remove the glycerol from the mixture obtained in step (iii) to obtain epoxy methyl ricinoleate via transesterification.

In yet another embodiment of the present invention, reactant used in step (i) is selected from the group consisting of methanol, ethanol, n-propanol, iso-propanol, water, acetic anhydride, acetone and diethyl amine.

In yet another embodiment of the present invention, catalyst used in step (ii) is Amberlyst-15, an acid catalyst for ring-opening to obtain ring-opened glyceryl ricinoleates, oxides derived from CaAl-LDH (layered double hydroxides), a base catalyst for transesterification to obtain epoxy alkyl ricinoleates and both Amberlyst-15 and oxides derived from CaAl-LDH (layered double hydroxides) are used to obtain ring-opened alkyl ricinoleates.

In yet another embodiment of the present invention, ring-opened alkyl ricinoleates are prepared in two-pot reactions by ring opening followed by transesterification or vice-versa.

In yet another embodiment of the present invention, ring-opening of ECO with methanol followed by transesterification of derived ring-opened glyceryl ricinoleates with methanol showed 81% conversion of ECO and 83% yield of transesterified products.

In yet another embodiment of the present invention, transesterification of ECO with methanol followed by ring-opening of derived epoxy methyl ricinoleate (EMR) with methanol showed 91% yield of transesterified products and 76% conversion of EMR.

In yet another embodiment of the present invention, ring-opened alkyl ricinoleates are prepared in a one-pot reaction using both acid and base catalysts together.

In yet another embodiment of the present invention, the catalyst used is recyclable up to 4 cycles.

In yet another embodiment of the present invention, the physical properties can be tuned by varying reactant used in step (i), reaction chemistry, and by blending prepared functionalized castor oil derivatives at different ratios, in particular but not limited to 1:1 w/w % ratio.

DETAILED DESCRIPTION OF THE INVENTION

Present invention relates to the process for the preparation of functionalized castor oil derivatives such as ring-opened glyceryl ricinoleates and epoxy alkyl ricinoleates from ECO. Functionalized castor oil derivatives were prepared by using heterogeneous acid or base catalysts by choosing proper reaction to do the functionalization at the specific region in ECO without affecting the other region. Furthermore, the present invention discloses a process for preparation of ring-opened alkyl ricinoleates by doing functionalization at both regions by using both acid and base catalysts in a two-pot as well one-pot reactions.

The processes for the preparation of ring-opened glyceryl ricinoleates via epoxy ring opening with a nucleophile using a solid acid catalyst, epoxy alkyl ricinoleates via transesterification with alcohols using a solid base catalyst and ring-opened alkyl ricinoleates using both solid acid and base catalysts from epoxidized castor oil comprise of the following steps:

(i) mixing epoxidized castor oil with methanol (or nucleophile) at room temperature
(ii) adding toluene as solvent to the mixture obtained in step (i) for ring-opening
(iii) adding catalyst(s) to the mixture obtained in step (ii) in the range of 0.5-20 wt. % w.r.t. oil
(iv) stirring of reaction mixture obtained in step (iii) at temperature in the range of 27-105° C.
(v) varying the reaction time in the range of 1 to 7 hours as mentioned in step iv
(vi) removing the catalyst(s) from the product mixture obtained in step (v) by decantation or filtration
(vii) adding water to remove the glycerol from the mixture obtained in step (vi) for transesterification
(viii) removing unreacted reagents and solvent from the mixture obtained in step (vii) by rotary evaporation, and if necessary preceded by solvent extraction with hexane
(ix) functionalized castor oil can be separated from the mixture obtained in step (viii) using suitable techniques Reactants used in step (i) as nucleophile is selected from the group consisting of methanol, ethanol, n-propanol, iso-propanol, water, acetic anhydride, acetone and diethyl amine for the preparation of ring-opened glyceryl ricinoleates.

The catalysts used in step (iii) are ion-exchange resins and layered double hydroxides (including their calcined forms).

The preparation of epoxy alkyl ricinoleates from epoxy methyl ricinoleate through transesterification using alcohols selected from ethanol, n-propanol and iso-proponal at reflux temperature.

The preparation of ring-opened alkyl ricinoleates in two-pot reactions by ring opening followed by transesterification or vice-versa.

The preparation of ring-opened alkyl ricinoleates in a one-pot reaction using both acid and base catalysts together.

In present invention, vary physical properties such as viscosity and oxidative stability of the functionalized castor oil derivatives by choosing proper reaction chemistry and/or nucleophile/alcohol.

In the present invention, tune the physical properties of functionalized castor oil derivatives by physical blending at different ratios, in particular but not limited to 1:1 w/w %.

The present invention provides a process for the preparation of functionalized castor oil derivatives such as ring-opened glyceryl ricinoleates, epoxy alkyl ricinoleates and ring-opened alkyl ricinoleates from epoxidized castor oil by epoxide ring opening or/and transesterification reactions using solid acid and base catalysts (FIGURE).

Ring-opened glyceryl ricinoleates can be prepared by ring opening of epoxidized castor oil (ECO) in presence of acid catalysts in which reaction occurs at the fatty region without affecting the ester region. Ring opening of ECO with methanol gave 82% conversion of ECO using Amberlyst 15 as solid acid catalyst in presence of toluene as solvent at 105° C. in 4 h reaction time. Catalyst was separated from the solution mixture by simple decantation and the collected catalyst was successfully reused up to 4 cycles. The collected organic layer was concentrated using a rotary evaporator and the conversion of reactant was computed using $^1$H NMR. The study was extended for the ring opening of ECO with different nucleophiles such as ethanol, n-propanol, iso-propanol, water, acetic anhydride, acetone and diethyl amine that rendered ECO conversion in the range of 23-69%. The reaction was successfully scaled up to 100 g of ECO with methanol as nucleophile with same efficacy.

Epoxy alkyl ricinoleates can be prepared by transesterification of ECO with alcohols in presence of base catalysts in which reaction occurs at the ester region without affecting fatty region. Srinivasan et al., have reported an improved process for preparation of fatty acid methyl esters in excellent yields from different triglyceride oils comprising edible, non-edible and used cooking oils using mixed metal oxides, in particular oxides derived from CaAl layered double hydroxide (CaAl-LDH) as reusable solid heterogeneous base catalysts using low alcohol:oil molar ratio (Process for preparation of fatty acid alkyl esters (biodiesel) from triglyceride oils using eco-friendly solid base catalysts, U.S. Pat. No. 9,029,583 B2 dated 12 May 2015). Extending the utility of this catalyst, transesterification of ECO with methanol at 65° C. gave 91% yield of epoxy methyl ricinoleate (transesterified product) using oxides derived from CaAl-LDH as solid base catalyst in 5 h. Catalyst was separated by filtration and was reused for 2 cycles. The recovered catalyst was recalcined at optimum temperature that showed an increase in the yield of transesterified product. Water was added to remove the glycerol from the organic layer. The collected organic layer was concentrated using a rotary evaporator and the yield of products was computed using $^1$H NMR. The study was extended for the transesterification of epoxy methyl ricinoleate (EMR; transesterified product of ECO with methanol) with ethanol, n-propanol and iso-propanol that resulted corresponding epoxy alkyl ricinoleates whose yield in the range of 49-23%. The reaction was successfully scaled up to 50 g with the same efficacy.

Ring-opened alkyl ricinoleates is an interesting molecule and that can be prepared from ECO by doing functionalization at both the regions in which further modifications are possible in both the regions. Methoxylated methyl ricinoleate (MMR) was prepared by ring-opening of ECO with methanol using Amberlyst 15 catalyst followed by transesterification of the ring-opened product with methanol using oxides derived from CaAl-LDH as catalyst (or) transesterification of ECO with methanol using oxides derived from CaAl-LDH as catalyst followed by ring-opening of the transesterified product with methanol using Amberlyst 15 catalyst. Here, ring-opening reactions were performed at 105° C. for 4 h and transesterification reactions were performed at 65° C. for 5 h. In both the ways, the conversions of oxirane ring towards ring-opened products are 81 and 76% whereas the yields of transesterified products are 83 and 91% respectively. The study was extended for the preparation of isopropoxylated methyl ricinoleate (IPMR) in which ring-opening of ECO was performed with iso-propanol followed by transesterification of the derived product with methanol that resulted 47% conversion of ECO with 81% yield of transesterified products. MMR was prepared from ECO in a one-pot reaction by taking both the catalysts together that resulted 61% conversion of ECO and 59% yield of transesterified products in 5 h.

Functionalized vegetable oils are well-known source for various industrial applications. In this invention, processes were developed and are reported for the first time for the preparation of functionalized castor oil derivatives from epoxidized castor oil (ECO) with tailorable physical properties using heterogeneous catalytic pathways namely ring opening and transesterification using acid and base catalysts respectively. The prior art cited does not teach the use of Amberlyst 15 and layered double hydroxide oxides for the refereed reactions. Ring opening of ECO with various nucleophiles using Amberlyst 15 as catalyst resulted in ring-opened castor polyols while retaining the glyceride moiety. Transesterification of ECO with methanol using oxides derived CaAl-LDH (layered double hydroxide) resulted functionalized ricinoleate derivatives while retaining the oxirane moiety. In both the cases, the derived molecules exhibit different physical properties depending on the extent of presence of glyceride/oxirane moiety and/or the nucleophile/alcohol. The other novel feature of the invention is that in a single pot synthesis, using both the catalysts viz Amberlyst 15 and oxides derived from LDH, both reactions namely ring opening and transesterification can be carried out simultaneously and in situ to ring-opened alkyl ricinoleates. Further, the physical properties can be tailored depending on the utility by suitably combining the product mixture obtained thereof at different ratios. Moreover, these catalysts have the advantage that it can be easily separated from the reaction medium and can be reused.

EXAMPLES

Following examples are given by way of illustration and therefore should not be construed to limit the scope of the invention.

Example: 1

500 mg of epoxidized castor oil (shortly ECO; Mol. wt. ~980) and 1 g of methanol (Methanol:ECO molar ratio=60:1) were taken along with 5 ml of toluene in a 25 ml round bottom (R.B.) flask at 27° C. 25 mg (5 wt. % w.r.t. oil) of solid acid catalyst (except MgAl3-LDH which is basic in nature) was added to the flask. The flask was then placed in a preheated oil bath at 60° C. and stirred well for 4 h. Catalyst (resin catalysts) was separated from the reaction mixture by simple decantation (sulphated zirconia and MgAl3-LDH were separated by centrifugation). Excess methanol and toluene were distilled out to get the ring-opened product and the solvent free sample was analyzed by $^{1}$H NMR. The conversion of ECO was 9-34% and the results are given in Table 1.

TABLE 1

Ring opening of ECO using different catalysts

| Catalyst | Conversion of ECO (%) |
|---|---|
| Amberlite IR 120 | 14 |
| Amberlite 200 C | 11 |
| Amberlyst 15 | 34 |
| Amberlite IRA 67 | 18 |
| Amberlite IRA-402 Cl | 16 |
| Amberlyst A-26 (OH) | 9 |
| Sulphated zirconia | 22 |
| Nafion | 15 |
| MgAl3-LDH | 12 |

Example: 2

500 mg of ECO and 5 g of methanol (Methanol:ECO molar ratio=300:1) were taken along with 3 ml of toluene in a 25 ml R.B. flask at 27° C. 25 mg (5 wt. % w.r.t. oil) of Amberlyst 15 was added to the flask. The flask was then placed in a preheated oil bath at 60° C. and stirred well for 4 h. The remaining process is repeated as given in Example: 1. The conversion of ECO was 66%.

Example: 3

500 mg of ECO and 3 g of methanol (Methanol:ECO molar ratio=180:1) were taken along with 3 ml of toluene in a 25 ml R.B. flask at 27° C. 100 mg (20 wt. % w.r.t. oil) of Amberlyst 15 was added to the flask. The flask was then placed in a preheated oil bath at 60° C. and stirred well for 4 h. Further processes were done as mentioned earlier in Example: 1. The conversion of ECO was 80%.

Example: 4

500 mg of ECO and 3 g of methanol (Methanol:ECO molar ratio=180:1) were taken along with 3 ml of toluene in a 25 ml R.B. flask at 27° C. 50 mg (10 wt. % w.r.t. oil) of Amberlyst 15 was added to the flask. The flask was then placed in a preheated oil bath at 60° C. and stirred well for 7 h. Further processes were done as mentioned earlier in Example: 1. The conversion of ECO was 78%.

Example: 5

500 mg of ECO and 3 g of methanol (Methanol:ECO molar ratio=180:1) were taken along with 3 ml of toluene in a 25 ml R.B. flask at 27° C. 50 mg (10 wt. % w.r.t. oil) of Amberlyst 15 was added to the flask. The flask was then placed in a preheated oil bath at 105° C. and stirred well for 4 h. Further processes were done as mentioned earlier in Example: 1. The conversion of ECO was 82%.

Example: 6

500 mg of ECO and different nucleophiles with nucleophile:oil molar ratio of 180:1 were taken along with 5 ml of toluene in a 25 ml R.B. flask at 27° C. 50 mg (10 wt. % w.r.t. oil) of Amberlyst 15 was added to the flask. The flask was then placed in a preheated oil bath at 105° C. and stirred well for 4 h. Further processes were done as mentioned earlier in Example: 1 and the results are given in Table 2.

TABLE 2

Ring opening with different nucleophiles

| Nucleophile | Nucleophile amount (g) | Conversion of ECO (%) |
|---|---|---|
| Methanol | 3 | 82 |
| Ethanol | 4.3 | 60 |
| n-propanol | 4.5 | 51 |
| Iso-propanol | 4.5 | 47 |
| Water | 1.7 | 49 |
| Acetic anhydride | 7.6 | 69 |
| Acetone | 4.3 | 39 |
| Diethyl amine | 5.5 | 24 |

Example: 7

100 g of ECO (viscosity=4625 cP at 25° C.) and 200 g of methanol (methanol:oil molar ratio=60:1) were taken along with 100 ml of toluene in a 500 ml R.B. flask at 27° C. To that 10 g (10 wt. % w.r.t. oil) of Amberlyst 15 was added to the flask. The flask was then placed in a preheated oil bath at 105° C. and stirred well for 4 h. Further processes were done as mentioned earlier in Example: 1. The derived product methoxylated castor polyol (MCP) showed viscosity of 1020 cP at 25° C. and oxidative stability of 42552 and 44 h at 30 and 110° C. respectively. Isopropoxylated castor polyol (IPCP) was prepared by taking 50 g of ECO and 125 g of iso-propanol along with 50 ml toluene in a 250 ml R.B. flask at 27° C. To that 5 g (10 wt. % w.r.t. oil) of Amberlyst 15 was added to the flask. The flask was then placed in a preheated oil bath at 105° C. and stirred well for 4 h. Further processes were done as mentioned earlier in Example: 1. IPCP showed viscosity of 4007 cP at 25° C. and oxidative stability of 112016 and 61 h at 30 and 110° C. respectively.

Aminated castor polyol (ACP) was prepared by taking 25 g of ECO and 103 g of diethyl amine along with 50 ml toluene in a 250 ml R.B. flask at 27° C. To that 2.5 g (10 wt. % w.r.t. oil) of Amberlyst 15 was added to the flask. The flask was then placed in a preheated oil bath at 105° C. and stirred well for 4 h. Further processes were done as mentioned earlier in Example: 1. ACP showed viscosity of 370 cP at 25° C. and oxidative stability of 194 h at 110° C.

Example: 8

500 mg of ECO and 3 g of methanol (Methanol:ECO molar ratio=180:1) was taken along with 3 ml of toluene in a 25 ml R.B. flask at 27° C. 50 mg (10 wt. % w.r.t. oil) of Amberlyst 15 was added to the flask. The flask was then placed in a preheated oil bath at 105° C. and stirred well for 4 h. Further processes were done as mentioned earlier in Example: 1.

TABLE 3

Reusability of the Amberlyst 15 catalyst for ring-opening of ECO

| Cycle number | Conversion of ECO (%) |
|---|---|
| 1 | 82 |
| 2 | 72 |
| 3 | 65 |
| 4 | 63 |

The collected catalyst was washed well with toluene and dried in oven at 100° C. for 1 h. Oven dried catalyst was used for next cycle by following the above mentioned procedure and the conversion of ECO was in the range of 82-63% (Table 3).

Example: 9

5 g of ECO and 3 g of methanol (methanol:ECO molar ratio=18:1) were taken in a 25 ml R.B. flask at 27° C. 250 mg of (5 wt. % w.r.t. oil) of oxides derived from CaAl-LDH was added to the flask. The flask was then placed in a preheated oil bath at 65° C. and stirred well for 5 h. Catalyst was separated by crucible separation. Water was added to separate the glycerol and then organic layer was extracted with hexane. The collected organic layer was subjected to rotary evaporation to get the transesterified product. Solvent free sample was analyzed by $^{1}$H NMR and the yield of epoxy methyl ricinoleate (EMR) was 91%. Reaction was successfully scaled up to 50 g of ECO.

The derived EMR showed viscosity of 48 cP at 25° C. and oxidative stability of 5221 and 23 h at 30 and 110° C. respectively.

Example: 10

5 g of epoxy methyl ricinoleate (EMR; M.W=~330) and various alcohols such as ethanol, n-propanol and iso-propanol (Alcohol:EMR molar ratio=6:1) were taken in a 25 ml R.B. flask at 27° C. 250 mg of (5 wt. % w.r.t. oil) of oxides derived from CaAl-LDH (solid base catalyst) was added to the flask. The flask was then placed in a preheated oil bath at reflux temperature of alcohols and stirred well for 5 h. Catalyst was separated by crucible separation. The collected organic layer was subjected to rotary evaporation to get the transesterified product. Solvent free sample was analyzed by $^{1}$H NMR. The yield of transesterified products (epoxy alkyl ricinoleates) are 49, 35 and 23% for ethanol, n-propanol and iso-propanol respectively. Reaction was scaled up to 35 g for the preparation of epoxy propyl ricinoleate (EPR; transesterified product of EMR with n-propanol). The derived EPR showed viscosity of 60 cP at 25° C. and oxidative stability of 27067 and 263 h at 30 and 110° C. respectively.

Example: 11

Catalyst separated from the process given in Example: 9, was dried in oven at 100° C. for 1 h and used for next cycle. The reaction procedure was repeated as mentioned earlier in Example: 9 and the yield of epoxy methyl ricinoleate was 27%. The collected catalyst after second cycle was recalcined at 700° C. for 5 h and the reaction were repeated as mentioned earlier in Example: 9 using the recalcined catalysts ($3^{rd}$ cycle) and the yield of epoxy methyl ricinoleate was 60%.

Example: 12

25 g of castor oil (CO) and 10 g of methanol (methanol: ECO molar ratio=12:1) were taken in a 100 ml R.B. flask at 27° C. 1.25 g of (5 wt. % w.r.t. oil) of oxides derived from CaAl-LDH was added to the flask. The flask was placed in a preheated oil bath at 65° C. and stirred well for 5 h. Catalyst was separated by crucible separation. Water was added to separate the glycerol and then organic layer was extracted with hexane. The collected organic layer was subjected to rotary evaporation to get the transesterified product. Solvent free sample was analyzed by $^{1}H$ NMR and the yield of methyl ricinoleate (MR) was 76%. CO showed viscosity of 360 cP at 25° C. and oxidative stability of 3581 and 119 h at 30 and 110° C. respectively. The castor oil derived MR showed viscosity of 22 cP at 25° C. and oxidative stability of 342 and 3 h at 30 and 110° C. respectively.

Example: 13

1 g of ECO and 6 g of methanol (methanol:oil molar ratio=180:1) were taken along with 5 ml of toluene in a 25 ml R.B. flask at 27° C. 100 mg (10 wt. % w.r.t. oil) of Amberlyst 15 was added to the flask. The flask was then placed in a preheated oil bath at 105° C. for 4 h. Further processes were done as mentioned earlier in Example: 1 and the conversion of ECO was 81%. 1 g of collected derivative (mainly contains methoxylated castor polyol; MCP) and 540 mg of methanol (methanol:oil molar ratio=~18:1) were taken in a 25 ml R.B. flask at 27° C. 50 mg of (5 wt. % w.r.t. oil) of oxides derived from CaAl-LDH (solid base catalyst) was added to the flask. The flask was then placed in a preheated oil bath at 65° C. for 5 h. Remaining procedures were done as mentioned earlier in Example: 9. The yield of transesterified products (mainly contains methoxy methyl ricinoleate; MMR) was 83%.

The reaction was successfully scaled up to 50 g of ECO (100 g of methanol; methanol:oil=60:1 molar ratio for the preparation of MCP for five times). 250 g of MCP (combined fraction of five experiments) was taken along with 135 g of methanol (methanol:oil molar ratio=~18:1) and 12.5 g of oxides derived from CaAl-LDH and the reaction was performed as mentioned earlier for the preparation of MMR. The yield of MMR was 83% which showed viscosity of 91 cP at 25° C. and oxidative stability of 195 and 194 h at 30 and 110° C. respectively.

Example: 14

5 g of ECO and 3 g of methanol (methanol:oil molar ratio=18:1) were taken in a 25 ml R.B. flask at 27° C. 250 mg of (5 wt. % w.r.t. oil) of oxides derived from CaAl-LDH (solid base catalyst) was added to the flask. The flask was then placed in a preheated oil bath at 65° C. for 5 h. Remaining procedures were done as mentioned earlier in Example: 9. The yield of transesterified products was 91%. 500 mg of collected derivative (mainly contains epoxy methyl ricinoleate; EMR) and 3 g of methanol (methanol:oil molar ratio=~60:1) were taken along with 5 ml of toluene in a 25 ml R.B. flask at 27° C. 50 mg (10 wt. % w.r.t. oil) of Amberlyst 15 was added to the flask. The flask was then placed in a preheated oil bath at 105° C. for 4 h. Further processes were done as mentioned earlier in Example: 1. The conversion of EMR was 76%.

Example: 15

50 g of ECO and 125 g of iso-propanol (methanol:oil=60:1 molar ratio) were taken along with 50 ml of toluene in a 250 ml R.B. flask at 27° C. 5 g (10 wt. % w.r.t. oil) of Amberlyst 15 was added to the flask. The flask was then placed in a preheated oil bath at 105° C. for 4 h. Further processes were done as mentioned earlier in Example: 1 and the conversion of oxirane ring is 47%. 50 g of collected derivative (mainly contains isopropoxylated castor polyol; IPCP) and 29 g of methanol (methanol:oil molar ratio=~18:1) were taken in a 250 ml R.B. flask at 27° C. 2.5 g of (5 wt. % w.r.t. oil) of oxides derived from CaAl-LDH (solid base catalyst) was added to the flask. The flask was placed in a preheated oil bath at 65° C. for 5 h. Remaining procedures were done as mentioned earlier in Example: 9. The yield of transesterified products is 81%. The derived isopropoxylated methyl ricinoleate (IPMR; ring-opened alkyl ricinoleates) showed viscosity of 70 cP at 25° C. and oxidative stability of 93865 and 35 h at 30 and 110° C. respectively.

Example: 16

2 g of ECO and 12 g of methanol (methanol:ECO molar ratio=180:1) were taken along with 10 ml of toluene in a 25 ml R.B. flask at 27° C. 200 mg (10 wt. % w.r.t. oil) of Amberlyst 15 and 100 mg (5 wt. % w.r.t. oil) of oxides derived from CaAl-LDH were added to the flask. The flask was then placed in a preheated oil bath at 105° C. and stirred well for 5 h. Catalysts were separated by centrifugation. Further processes were done as mentioned earlier in Example: 9. The conversion of ECO and the yield of transesterified product was 61 and 59% respectively.

Example: 17

12.5 of CO was blended with 12.5 g of ECO (1:1 w/w % ratio) at 27° C. and mixed well by glass rod to get homogeneous product. The same procedure was repeated for the preparation of castor derived blended derivatives using functionalized castor derivatives such as ring-opened glyceryl ricinoleates, epoxy alkyl ricinoleates and ring-opened alkyl ricinoleates as blending sources and the physical properties of the blended derivatives are given in Table 4.

TABLE 4

Physical properties of 1:1 w/w % ratio blended functionalized castor derivatives

| Derivative 1 | Derivative 2 | Viscosity (Cp) at 25° C. | Oxidative stability at 30° C. (h) | Oxidative stability at 110° C. (h) |
|---|---|---|---|---|
| CO | ECO | 972 | 4951 | 15 |
| MCP | IPCP | 1644 | 1298 | 3 |
| MR | EMR | 24 | 5051 | 194 |
| EMR | EPR | 72 | 34510 | 270 |
| MMR | IPMR | 103 | 21 | 21 |

ADVANTAGES OF THE INVENTION

Simple process
Diverse castor-oil based derivatives
Low cost and commercial catalysts
Simple separation processes
High activity of the catalysts rendering maximum conversion (or) yield
Recyclable catalysts
Tailorable physical properties
Flexibility by blending the derivatives

We claim:

1. A process for the preparation of functionalized castor oil derivatives from epoxidized castor oil (ECO) via ring-opening and/or transesterification, wherein conversion percentage of epoxidized castor oil is in the range of 82 to 91% comprising the steps of:

(i) mixing epoxidized castor oil with a nucleophile at room temperature in the range of 20 to 30° C. to obtain a mixture;

(ii) adding heterogeneous catalyst(s) to the mixture as obtained in step (i) in the range of 0.5-20 wt. % with respect to oil to obtain a mixture;

(iii) stirring the mixture as obtained in step (ii) at temperature in the range of 27-105° C. for period in the range of 1 to 7 hours followed by decanting/filtering the catalyst(s) to obtain a product mixture;

(iv) removing unreacted reagents and solvent from the mixture obtained in step (iii) by rotary evaporation, and if optionally preceded by solvent extraction with hexane to obtain functionalized castor oil derivatives; and (v) optionally mixing functionalized castor oil derivative as obtained in step (iv) with the nucleophile as in step (i) and following the steps (ii) to (iv) to obtain functionalized castor oil derivatives, wherein the functionalized castor oil derivatives are selected from the group consisting of ring-opened glyceryl ricinoleates, epoxy alkyl ricinoleates and ring-opened alkyl ricinoleates.

2. The process as claimed in claim 1, wherein the nucleophile used in step (i) is methanol, to obtain ring-opened glyceryl ricinoleate via ring-opening and epoxy methyl ricinoleate via transesterification.

3. The process as claimed in claim 1, wherein toluene is added as solvent to the mixture obtained in step (i) before the addition of catalyst to obtain ring-opened glyceryl ricinoleates and ring-opened alkyl ricinoleates.

4. The process as claimed in claim 1, wherein water is added to the mixture obtained in step (iii) to form an aqueous layer and an organic layer, and extracting the organic layer with hexane to obtain transesterified epoxy methyl ricinoleate.

5. The process as claimed in claim 1, wherein the nucleophile used in step (i) is selected from the group consisting of methanol, ethanol, n-propanol, iso-propanol, water, acetic anhydride, acetone and diethyl amine.

6. The process as claimed of claim 1, wherein catalyst used in step (ii) is Amberlyst-15, an acid catalyst for ring-opening to obtain ring-opened glyceryl ricinoleates, oxides derived from CaAl-LDH (layered double hydroxides), a base catalyst for transesterification to obtain epoxy alkyl ricinoleates both Amberlyst-15 and oxides derived from CaAl-LDH (layered double hydroxides) are used to obtain ring-opened alkyl ricinoleates.

7. The process as claimed in claim 1, wherein the ring-opened alkyl ricinoleates are prepared in two-pot reactions by ring opening followed by transesterification or vice-versa.

8. The process as claimed in claim 7, wherein ring-opening of ECO with methanol followed by transesterification of derived ring-opened glyceryl ricinoleates with methanol results in 81% conversion of ECO and 83% yield of transesterified products.

9. The process as claimed in claim 7, wherein transesterification of ECO with methanol followed by ring-opening of derived epoxy methyl ricinoleate (EMR) with methanol results in 91% yield of transesterified products and 76% conversion of EMR.

10. The process as claimed in claim 1, wherein the ring-opened alkyl ricinoleates are prepared in a one-pot reaction using both acid and base catalysts together.

11. The process as claimed in claim 1, wherein the catalyst used is recycled up to 4 cycles.

12. The process as claimed in claim 1, wherein the physical properties of the functionalized castor oil derivatives can be tuned by varying the nucleophile used in step (i), the catalyst(s), and/or by blending prepared functionalized castor oil derivatives at different ratios.

* * * * *